US005514053A

United States Patent [19]

Hawkins et al.

[11] Patent Number: 5,514,053

[45] Date of Patent: May 7, 1996

[54] RECUMBENT PEDAL EXERCISER

[76] Inventors: Tranel Hawkins, 831 Spencer Ave., San Jose, Calif. 95125; Robert S. Smith, 1263 Emory St., San Jose, Calif. 95126

[21] Appl. No.: 319,325

[22] Filed: Oct. 6, 1994

Related U.S. Application Data

[63] Continuation-in-part of Ser. No. 61,779, May 12, 1993, abandoned, which is a continuation-in-part of Ser. No. 900,154, Jun. 17, 1992, abandoned.

[51] Int. Cl.[6] ..... A63B 22/00

[52] U.S. Cl. ..... 482/63; 482/64; 482/65; 601/36

[58] Field of Search ..... 482/57, 60, 63, 482/64, 65, 70, 72, 79, 148; 601/23, 24, 33, 34, 35, 36

[56] References Cited

U.S. PATENT DOCUMENTS

| | | | |
|---|---|---|---|
| 3,824,994 | 7/1974 | Soderberg, Sr. | 601/29 |
| 4,047,715 | 9/1977 | Gjessing | 482/64 |
| 4,282,865 | 8/1981 | Pogue | 601/26 |
| 4,550,908 | 11/1985 | Dixon | 482/79 |
| 4,953,415 | 9/1990 | Lehtonen | 482/64 |
| 5,039,091 | 8/1991 | Johnson | 482/64 |
| 5,125,677 | 6/1992 | Ogilvie et al. | 482/57 |

FOREIGN PATENT DOCUMENTS

| | | | |
|---|---|---|---|
| 9111219 | 8/1991 | WIPO | 482/70 |

*Primary Examiner*—Richard J. Apley
*Assistant Examiner*—Jeanne M. Clark
*Attorney, Agent, or Firm*—Robert Samuel Smith

[57] ABSTRACT

An exercise apparatus for performing recumbent pedalling exercises including pedals slidably mounted on a substantially horizontal track, a belt having one end secured to each pedal extending back toward the user over an idler then to a drive shaft so that the belt unwinds from the drive shaft as the pedals are pressed along the track. Each drive shaft (one for each pedal) is coupled to a resistance wheel assembly through a one way clutch. The drive shaft is spring loaded so that each pedal returns to a starting position after being extend. Each pedal operates independent of the other pedal. In one embodiment, the resistance wheel assembly includes a fan in which resistance to turning can be controlled by controlling the width of expandable blades, by partially covering up the fan blades or by a variable transmission coupling the fan to the drive shaft. In another embodiment, the resistance wheel assembly includes a rubber wheel in contact with a roller. Force of the roller against the wheel may be controlled by any one of a number of means including a mechanical or electrical actuator.

32 Claims, 11 Drawing Sheets

RECUMBENT PEDAL EXERCISER

This is a continuation-in-part of application(s) Ser. No. 08/061,779 filed on May 12, 1993, now abandoned, which is a continuation-in-part of Ser. No. 07/900,054, filed Jun. 17, 1992, abandoned.

BACKGROUND

1. Field of the Invention

This invention relates to exercisers and particularly to an exerciser of the type wherein the user sits on a seat in a recumbent position and pedals. In the context of this specification, recumbent is defined as meaning a posture that is between lying down and sitting erect as when a user is sitting on a bicycle seat.

2. Prior Art and Information Disclosure Statement

Differences in motivation to exercise tends to separate the exercising public into categories. In one category, the motivation is to develop explosive strength and/or muscle mass and a comparatively minor amount of endurance in order to excel in a sport that requires that kind of physical development. This kind of exercise involves heavy resistance and the ability to control the resistance very accurately in order to increase the resistance to performing the exercise in small accurately controlled increments. Most all of the equipment developed for this type of exercise involves the use of weights to provide resistance. Free weights are an example of equipment used in this type of exercise. However, apparatus have also been disclosed in which weights provide the resistance but the weights are hung on the apparatus and used in such a way that exercise in important ranges of motion can be performed that cannot be performed by free weights. Examples of this type of apparatus are apparatus manufactured by the Spartan Manufacturing Co. in Santa Clara, Calif. The line of equipment from this company includes a self spotting machine in which exercises can be performed such as the bench press, squat, etc. in which the apparatus provides the user with the capability to lock the bar in any vertical location at any point in his exercise.

Another Spartan apparatus is the "LOWER BODY ISOLATOR" in which the user can perform many exercises for the lower body. The apparatus includes a bench and foot operated levers coupled by a cable and pulley system to a variable weight stack. The operator sits on the bench and performs leg presses beginning with his knees close to his chest and moving his feet in an arc to end the stroke with his legs straight out in front of him.

Another large segment of the exercising public has comparatively little interest in developing strength and/or muscle mass. Their motivation is to maintain good health by performing "aerobic" exercises. These exercise involve only moderate resistance with many repetitions. While it is desirable to have the capability to control the resistive force, the control need not be as precise as characterizes the "anaerobic" type of equipment. Popular exercisers for performing this type of exercise that have appeared on the market include steppers, rowing machines, treadmills and stationary bicycles.

Still another important segment of the exercising public are patients and invalids that MUST have exercise in order to recover from dehabilitating illnesses or operations. Normal procedure is to prescribe walking as soon as the patient is able. However the transition from lying flat on one's back to taking the first steps is often a major one, particularly for stroke victims who have lost their sense of balance. In some cases, the sense of balance is lost completely and permanently but this situation does not diminish the patients need to exercise his lower limbs to improve or maintain cardiovascular function.

U.S. Patent to Sweeney et al is for a stepper (or stair climber) having two pedals, each pedal mounted on its own lever assembly. Each lever assembly includes a lever attached to one end of a sprocket chain whose other end is attached to a spring return. The sprocket chain is looped over a sprocket gear, each gear mounted on its own oneway clutch. The pair of clutches are coupled to a single flywheel. The separate spring return for each lever arm provides that the pedals drive the single flywheel independently of one another. One problem with this device is that a practical length of the lever arm severely restricts the range of travel. Another problem is that the motion of the lever is arcurate rather than linear. Another characteristic of the device is that the restoring force depends entirely on the force constant of the spring. This places a limit on the speed with which the pedal can be returned to its starting position. The most desirable situation, therefore, is to have an effective restoring force that is large throughout the entire range of displacement of the pedal in order to have a sufficiently fast return of the pedal. This can only be achieved approximately by the Sweeney invention by having a long spring as shown in the Sweeney patent. This inherently requires that the spring and section of chain required for the return be quite long which adds additional length and bulk to the apparatus. The device is operated by the user standing erect rather than in a recumbent position, contrary to the object of this invention. Resistive force is imposed on the flywheel by a band. The problem with this type construction for applying resistive force is that the band wears, breaks, and has to be replaced.

U.S. Pat. No. 4,900,013 to Rodgers is for a recumbent exerciser including a pair of pedals (travellers), each slidably mounted on one of a pair of parallel tracks respectively. Each endless chain is looped around its a pair of sprocket gears. One of the sprocket gears is coupled to a flywheel through its own oneway clutch at the other end of the tracks. The two sprockets are coupled together providing that, when one pedal is forced in one direction to drive the flywheel, the other pedal is returned to a starting position so that the pedals do not operate independent of one another. Resistance to turning the flywheel is provided by a friction band around the perphery of the flywheel. The Rogers construction shows the flywheel mounted in back of the seated user. This construction thereby requires that the track be mounted at a lower elevation than the seat of the user which restricts the range of motion for exercising the legs.

U.S. Pat. No. 4,875,674 to Dreissigackercker et al is for an energy absorbing means to be used to measure the power applied by a user operating an exerciser such as a rowing machine. The power dissipated during the exercise is measured and used to disengage the braking force when the force exceeds a predetermined value. In one embodiment, the resistive force is provided by the wind resistance developed by a rotating fan. In another embodiment, the resistive force is imposed by a flywheel provided with a friction band wrapped around its periphery.

U.S. Pat. No. 4,943,050, to Smith is for a one leg exerciser including a wheel with a rubber tire, rotatably mounted with the axle horizontal, providing that the user may stand on one floor and stroke the wheel with the other foot. A roller is adjustably forced against the rubber tire to provide variable resistance to turning.

U.S. Pat. No. 4,261,562 to Flavell is for an electromagnetically regulated exerciser showing but not claiming a cable wrapped around a spool coupled through a one way clutch to an electromagnetic resistance means to provide proportioned isokinetic resistance which increases by an amount that the user exceeds a preset value. The cable around a spool shown in the Flavell patent is configured for pulling by hand using an attached stirrup (co. 2) and could not be used in an application where it is required to maintain a constant line of force applied to pulling the cable. As shown in FIG. 1 the line of force varies as the cable wanders along the spool as the spool turns. In order to overcome this problem in adapting his resistance monitor to a "bicycle" type of exerciser, Flavell dispenses with the spool and cable altogether and incorporates a sprocket chain and socket gear to drive his resistance mechanism This approach suffers from the fact that the chain can slip on the sprocket if the resistance to turning is great enough.

Aerobic exercises, such as are performed using equipment of the type described above in the patents to Rogers, Sweeney, Dreissigackercker, are performed to develop and improve the cardiovascular system which includes not only the heart but also arteries and veins that go to all parts of the body. Many repetitions performed with comparatively light resistance provide the benefit of increasing the density of capillaries, enlarging arteries and reducing deposit buildup in the arteries of those limbs, particularly the legs, which perform this type of exercise. With many people, particularly recovering heart patients, their hearts cannot sustain the exertion required to perform repetitious exercise of the legs even though the vascular system in the legs will benefit. Therefore, it would be advantageous to perform exercises with the legs which are low resistance and repetitious but in which the effort required by the heart is minimized.

Exercises performed with the Sweeneey, Smith and Rogers inventions are aerobic exercises that develop the hamstrings and quadriceps. These apparatus do not exercise the gluteous muscles because none of these apparatus permit the user to bring his knees close to his chest. The basic configuration of these devices does not permit a straight line drive of the feet from a position where the knees are close to the chest to a position where the legs are fully extended. From the standpoint of aerobic conditioning, this is an important failing since the gluteous muscles are the largest most powerful muscles in the body and the most beneficial workout would isolate on the use of these muscles.

Another important failing of these devices is that they do not provide for "COASTING OF THE RESISTANCE MECHANISM":. The consequence of this omission is that the resistance wheel slows down during the return stroke so that the velocity of the wheel becomes a complicated function of not only how fast and hard he applies his driving stroke but also the speed of his return stroke.

Another limitation of the devices of the prior art is they do not accomodate for the fact that the force that can be applied by the legs varies with the degree of extension of the leg. The force that can be exerted when the leg is nearly straight is much greater than the force that can be applied when the knees are close to the chest.

THE INVENTION

OBJECTS

It is an object of this invention to provide a recumbent stepper exerciser.

It is another object to provide a recumbent stepper exerciser adaptable to a seated user or to a user lying in bed.

It is another object to provide a recumbent stepper having linear motion of the pedals in which the user can perform the exercise by bringing his knees close to his chest and drive them to a position where his legs are fully extended thereby permitting the hip and knee extensors to be exercised in their full range of motion.

It is another object to provide an exerciser in which the resistance means can coast during the return stroke thereby avoiding loss of speed of the resistance means and rendering the speed and force of the drive stroke completely independent of the return stroke.

It is another object that resistance to driving the pedals be a function of position of the pedals.

It is another object that the pedals operate independently of one another.

It is another object that the resistive force be a function of the speed of operating the pedals and that this function be controllable.

It is another object to provide an apparatus for performing exercises in which comparative strain on the heart is reduced while stimulating development of the vascular system.

It is another object to provide a resistive force operating the pedals which has an inherently longer life than the friction designs of the prior art which employ bands under tension.

It is another object to develop a recumbent stepper that can be used by a bedridden user.

It is another object to provide means to control of a resistant means dependant on speed that is expensive and covers a wider range of force than the electromagnetic devices of the prior art.

SUMMARY

This invention is directed toward a recumbent pedal exerciser in which the motion of each pedal is linear and independent of the motion of the other pedal.

In one embodiment, resistance to operating the pedals by a seated user is provided by a rotating fan. Wind resistance to turning the fan is controlled by controlling the effective area of the fan blades.

Several constructions may be used to control the effective area of the fan blades.

In one embodiment, control of the fan blades is accomplished by positioning the blades behind a shield. When the blades are completely shielded, the resistive torque to taming the blades is relatively constant since the body of air trapped with the blades moves with the blades. When the shield is removed from the blades by sliding the shield on its shaft away from the fan blades, the resistive force is proportional to the square of the velocity of the blades as has been well established in fan technology.

In another construction for controlling effective area, each blade consists of sections that interleave when it is required to minimize wind resistance and separate when it is required to increase wind resistance.

Still another construction for controlling wind resistance is to connect the pedal operated driving means to the fan by a continuously variable transmission thereby providing the means to regulate rotational velocity of the fan. In one embodiment, the transmission ratio is set manually. In another embodiment, a signal corresponding to the rotational velocity of the first cone operates a linear actuator to drive a rider between the cones to a preselected position thereby controlling the velocity of the second cone of the variable transmission.

Another embodiment for applying resistance to operating the pedals is provided by a rotating wheel assembly including a wheel with a rubber tire. A roller is pressed in contact with the wheel with a variable force. Resistance is generated by deformation of the tire in contact with the roller so that the tire does not wear in contrast to a friction band wrapped around a wheel. A linkage between the roller and the pedal provides that the force exerted by the roller against the tire is a function of the position of the pedal. Therefore, the force required to move the pedal can be accomodated to the flexion of the leg. According to this embodiment, the force required to move the pedal when the legs are extended can be made greater than when the legs are contracted which accomodates the legs ability to apply greater force when in the extended condition than when in the contracted condition. Also according to this embodiment, the roller can be withdrawn from the wheel when the pedal is retracted providing that resistive force is applied when the user is pushing on the pedal but the wheel can "coast" when the pedal is retracted. With this arrangement, the resistance wheel will not slow down during the return movement of the pedal nor will the resistance depend on the period between drive strokes, which is a decided advantage.

The seat is located at one end of an elongated base and the track on which the pedals are slidably mounted is on the other end of the base. The track is positioned ABOVE the resistance wheel. This arrangement, which is a departure from the prior art, accomplishes three objects.

The first object is that it places the pedals above the level of the heart. This structural feature reduces relative effort of the heart required to sustain the repetitious activity of the legs and thereby maximizes the efficiency for improving the vascularity of the legs.

The second object is that it reduces the complexity of the chain assembly of the prior art (as in the Rogers Patent) which requires a continuous chain and two sprocket gears in order to provide linear motion of the pedals.

The third object is that it reduces the floor space required for the apparatus compared to devices described in the prior art such as the Rogers invention.

A practical arrangement for locating the track above the level of the heart is facilitated by two structural features ot the invention.

One structural feature is a base that has adjustable legs so that the inclination of the track is adjustable.

A second structural feature is a seat that is positioned on one section of the base, and the pedals and track are positioned on a second section. The two sections are hinged together providing that the track may be inclined with respect to the seat in order to obtain a more natural movement of the feet.

Each pedal is coupled to one end of one of a pair of linkages, (chain, belt, etc.) respectively. Each linkage has another end secured to one of a pair of driveshafts, respectively which is coupled through a one way clutch to a wheel assembly arranged so that each pedal drives the resistance wheel in the same direction. The linkage may be any suitable transmission medium such as a V belt, sprocket chain or flat belt however, the flat belt is preferred for reasons discussed below.

Securing the second end of the belt to the driveshaft (rather than to a separate spring return as in Sweeney or having a continuous chain as in Rogers) provides two major advantages. The first is that construction is inherently more compact. The second advantage is, that with a flat belt linkage, the flat belt forms a flat coil around the drive shaft as the drive shaft turns and this coil grows so that the effective restoring force constant of the spring return is increased. This is an important feature for shortening the period required for the return of the pedal to the starting position and makes the period of the return less dependent on the length of the stroke. The use of a flat belt is an important embodiment of this invention. In order to further increase the effective restoring force constant of the spring return, it is a another embodiment to impose a flexible wedge on the belt.

DRAWINGS

FIG. 10 A shows the growing flat coil configuration assumed by the flat belt linkage as the driveshaft turns and the flat belt wraps around the driveshaft.

Figure 10A:
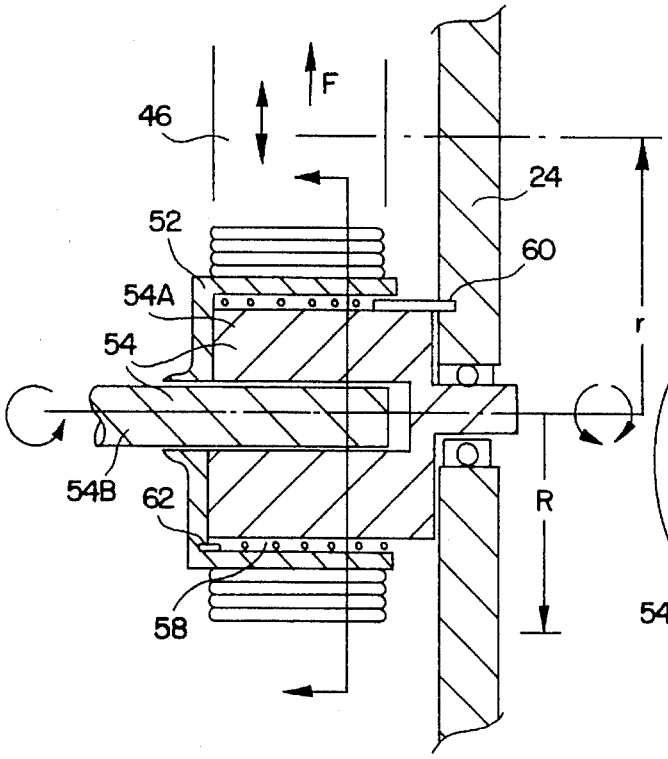
Figure 10B:
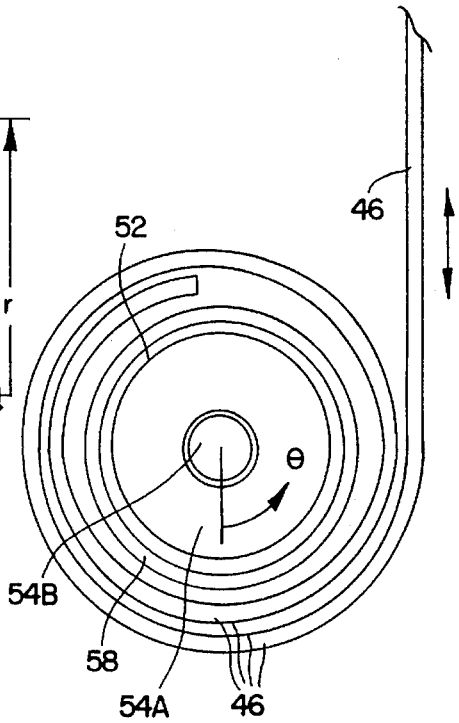

FIG. 10B is a side view of FIG. 10A.

Figure 11:
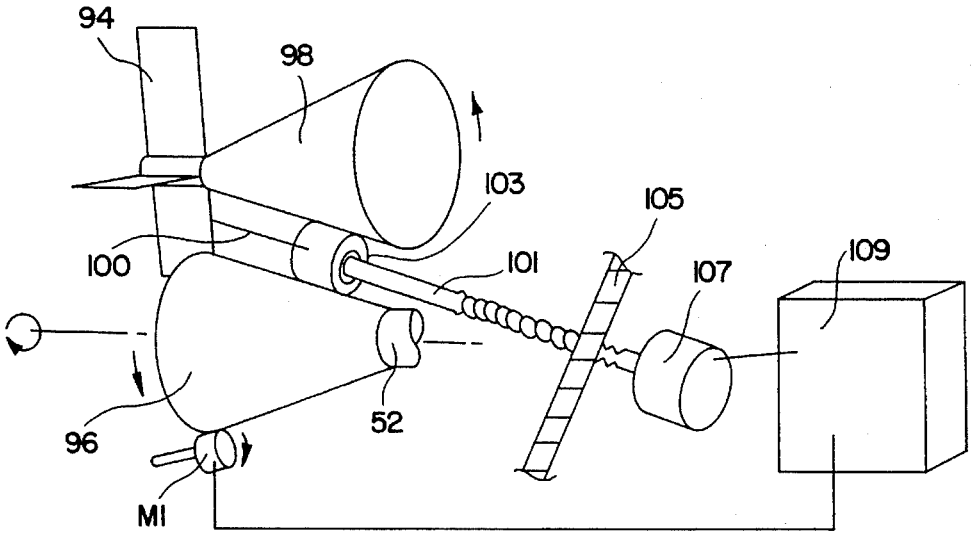

FIG. 11 shows electronic control of a continuously variable transmission.

Figure 12:
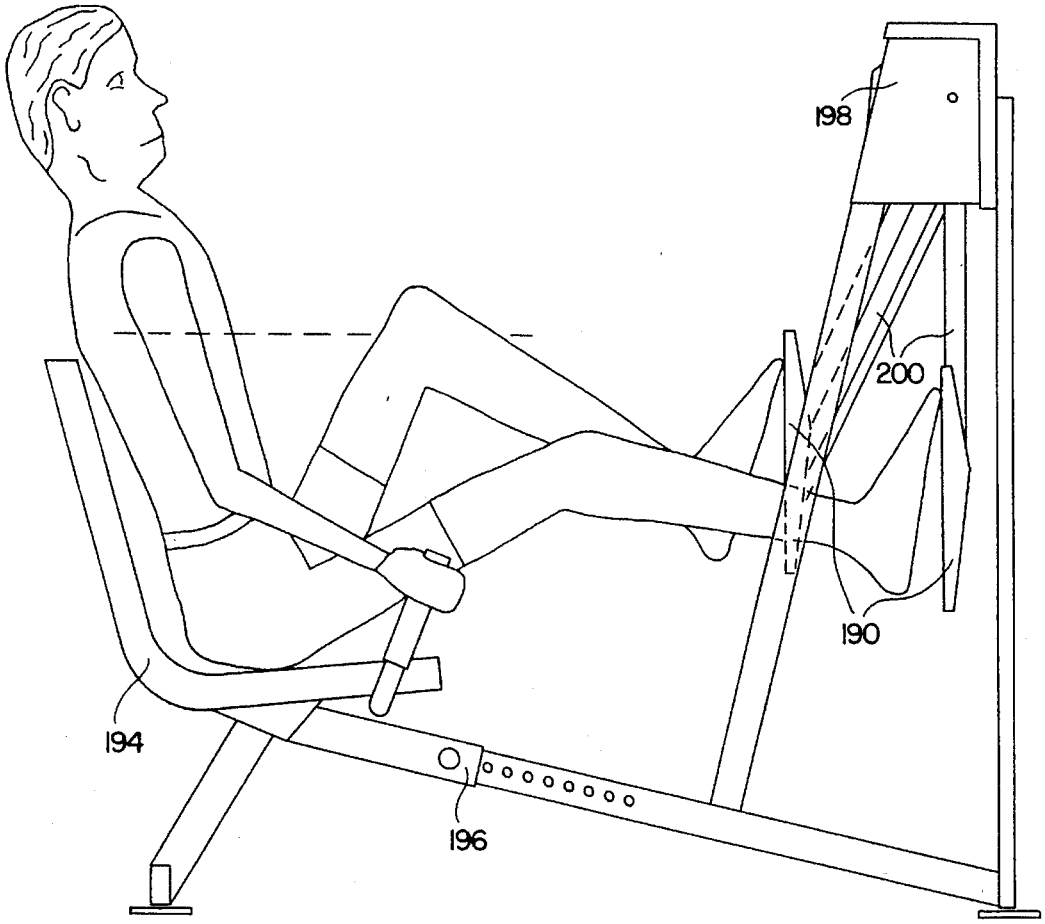

FIG. 12 shows another version of the recumbent pedal exerciser.

Figure 13:
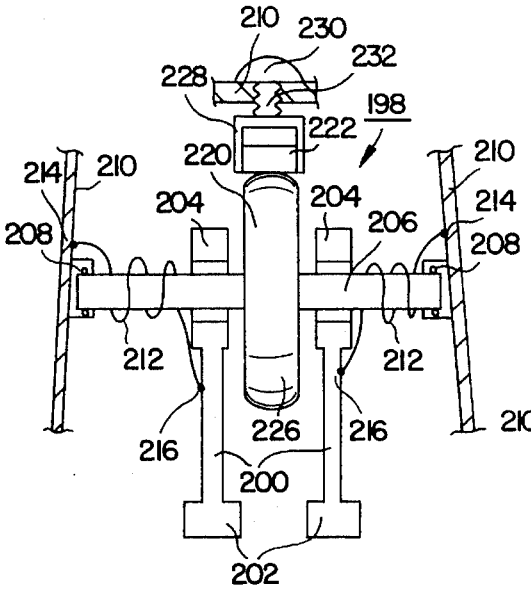

FIG. 13 shows a resistive means with a worm gear.

Figure 14:
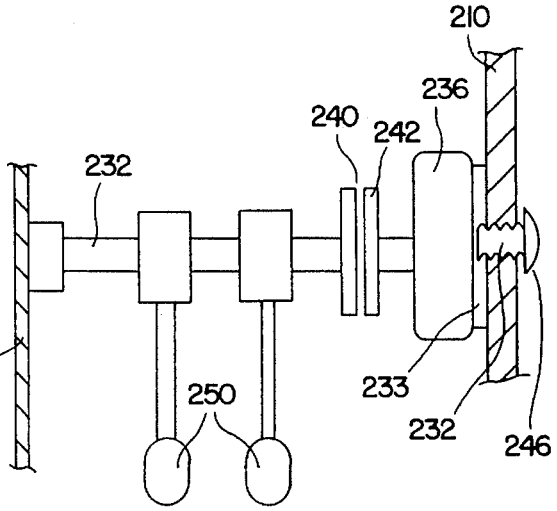

FIG. 14 shows a resistive means with a motor and friction clutch.

Figure 15:
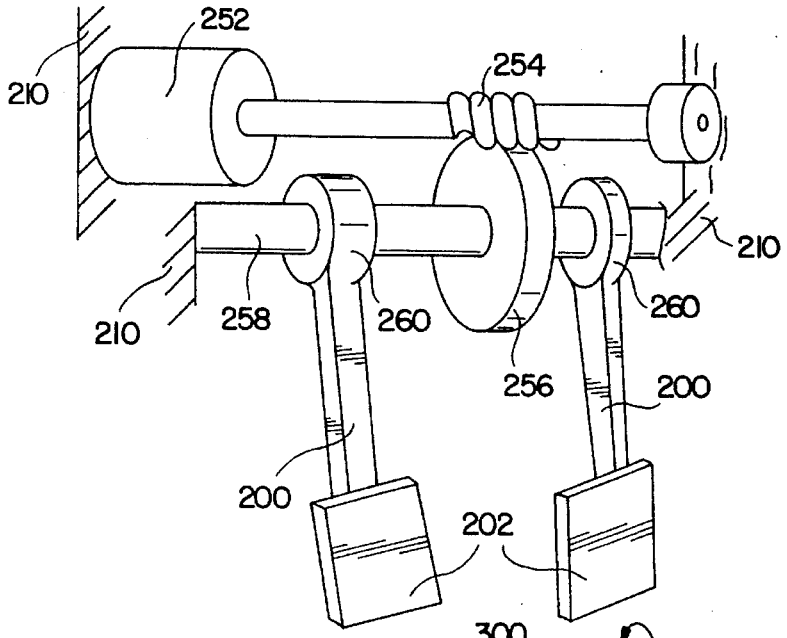

FIG. 15 shows a resistive means with a motor and worm gear.

Figure 16:
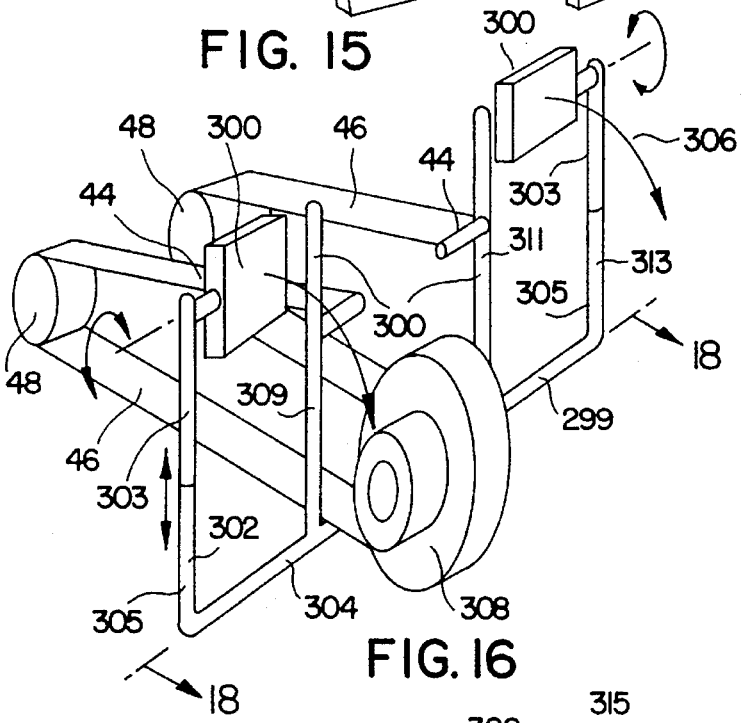

FIG. 16 shows a guide for moving the pedals on an arc

Figure 17:
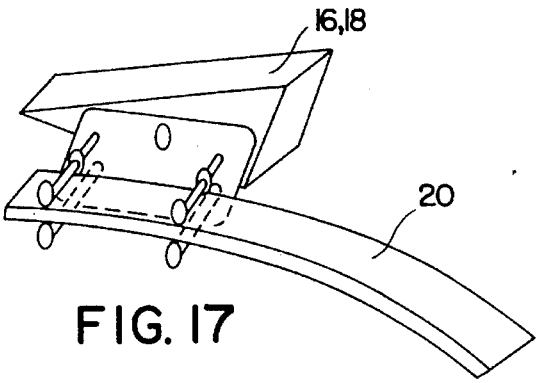

FIG. 17 shows a curved track.

Figure 18:
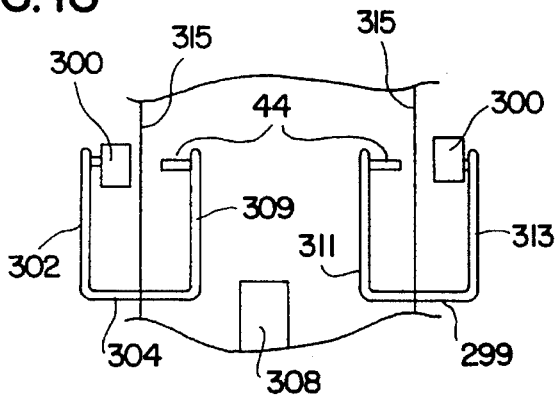

FIG. 18 is a sectional view taken from FIG. 16.

Figure 1A:
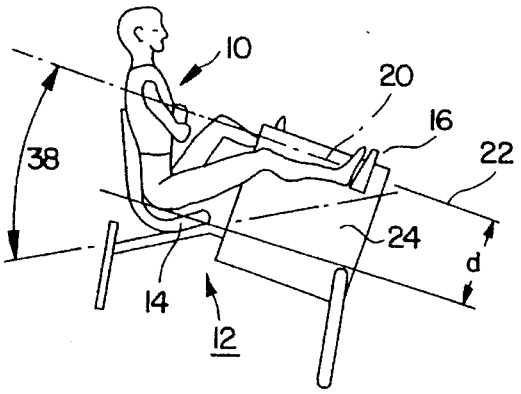
FIG. 1A shows a figurative illustration of a user operating the recumbent stepper of this invention.

DESCRIPTION OF THE PREFERRED EMBODIMENT:

Turning now to a discussion of the drawings, FIG. 1A shows a figurative diagram of a user 10 operating the linear stepper 12 of this invention. The user 10 is seated in an adjustable seat 14. His feet are positioned on a pair of pedals 16 and 18. The pedals move on a linear track 20 independent of one another in the sense that each pedal will return to its starting position after the stroke independent of the position of the other foot. The track 20 is substantially horizontal and positioned at an elevation 22 that is close to the users heart.

Figure 1B:
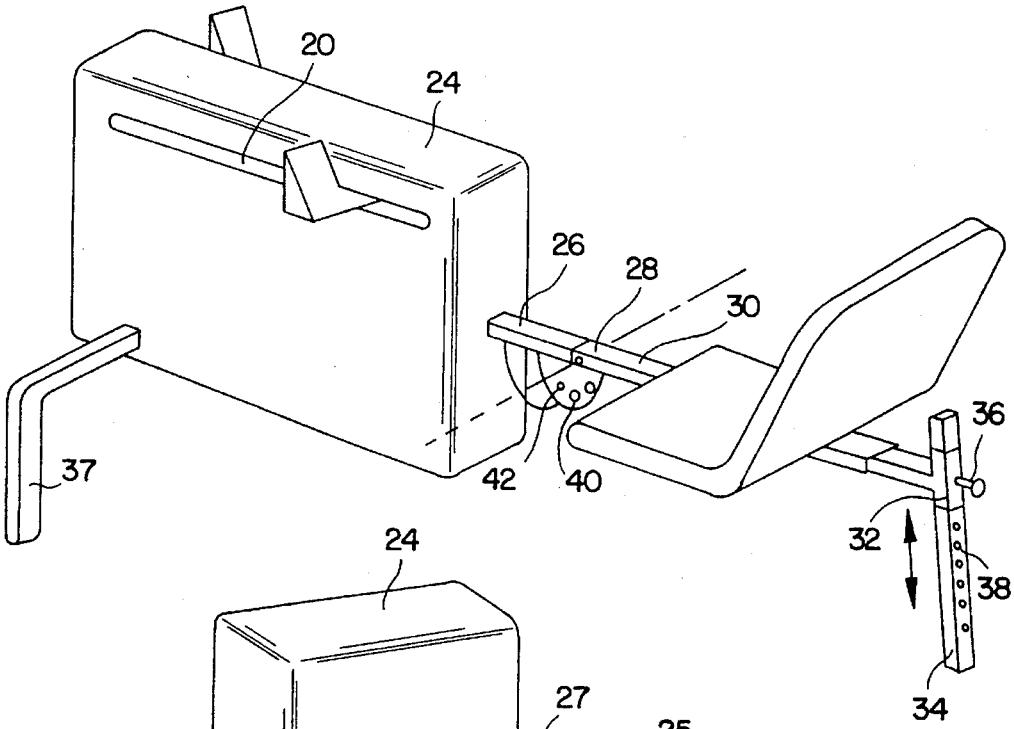
FIG. 1B shows an overall perspective view of the recumbent stepper.

FIG. 1B shows adjustments that are provided to position the track 20 with respect to the seat 14. The track and resistance mechanism are enclosed in a housing 24. A first beam 26 extends from the housing 24 and is attached by hinge 28 to a second beam 30 which slidably supports the seat 14. The end 32 of beam 30 is secured onto leg 34 and its location of attachment to leg 34 can be selected and fixed by a spring loaded pin 36 in a selected one of holes 38. The end of the housing 24 opposite the seat is supported by a pair of legs 37. (one leg is shown).

The seat 14 can be adjusted to accomodate the length of the user's legs by sliding the seat 14 along beam 30. The height (d in FIG. 1A) of the track 20 above the user can be adjusted by the slidable connection between leg 34 and the end 32 of beam 30. The angle 38 between the seat 14 and the track 20 can be adjusted by turning the beam about the hinge 28 and securing the hinge 28 by a pin 40 in one of holes 42.

These adjustments permit the user to adjust the distance, d, of the elevation of the track above the level of the seat 14 in order to position the track at or above the level of the heart. A useful value of distance, d, for this purpose is 5 to 75 centimeters.

Figure 1C:
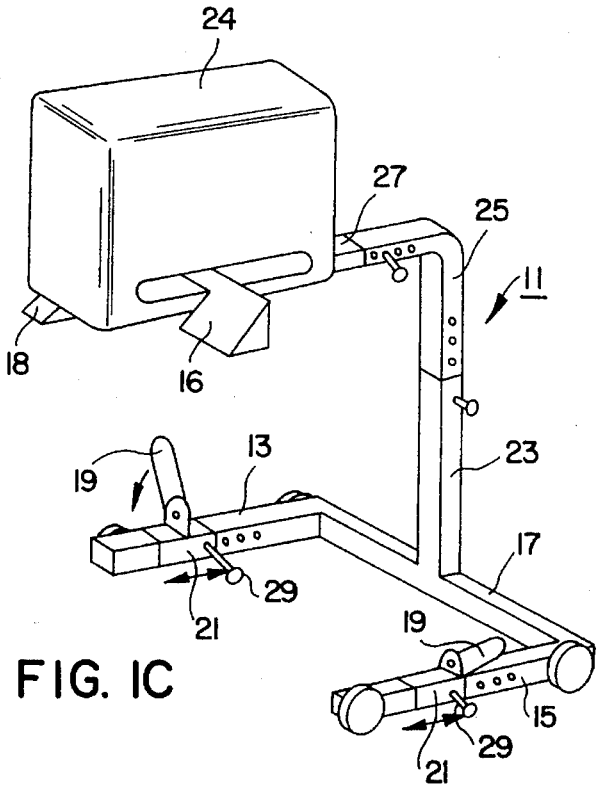
FIG. 1C shows the recumbent stepper adapted for use by a bedridden user.

FIG. 1 C shows the recumbent exerciser of this invention adapted for a user lying in bed. In this embodiment, the housing 24 is inverted so that the track is below the resistance mechanism within the housing. The housing 24 is supported on a frame 11 which is contoured to straddle the end of a bed so that the patient can lie flat on his back and operate the pedals with his feet. The frame includes two horizontal members 13 and 15 joined by horizontal member to form a U shaped brace. Catches 19 are hingably secured to sleeves 21 which may be positioned and secured by pin 29 to brace against the legs of the bed as the user pushes on the pedals 18 and 16. Vertical member 23 extends from member 17 and telescopes into one end of elbow 25 whose other end telescopes into upper beam 27 which supports the housing 24. The frame 11 may be mounted on wheels 23 enabling the exerciser to be rolled conveniently into position. Once in position, the wheels would be braked. Brakes are not shown in FIG. 1C however there are many coaster wheels with brakes available in the marketplace.

Details of the resistance mechanism within housing 24 are described with reference to FIGS. 2–10.

Figure 2:
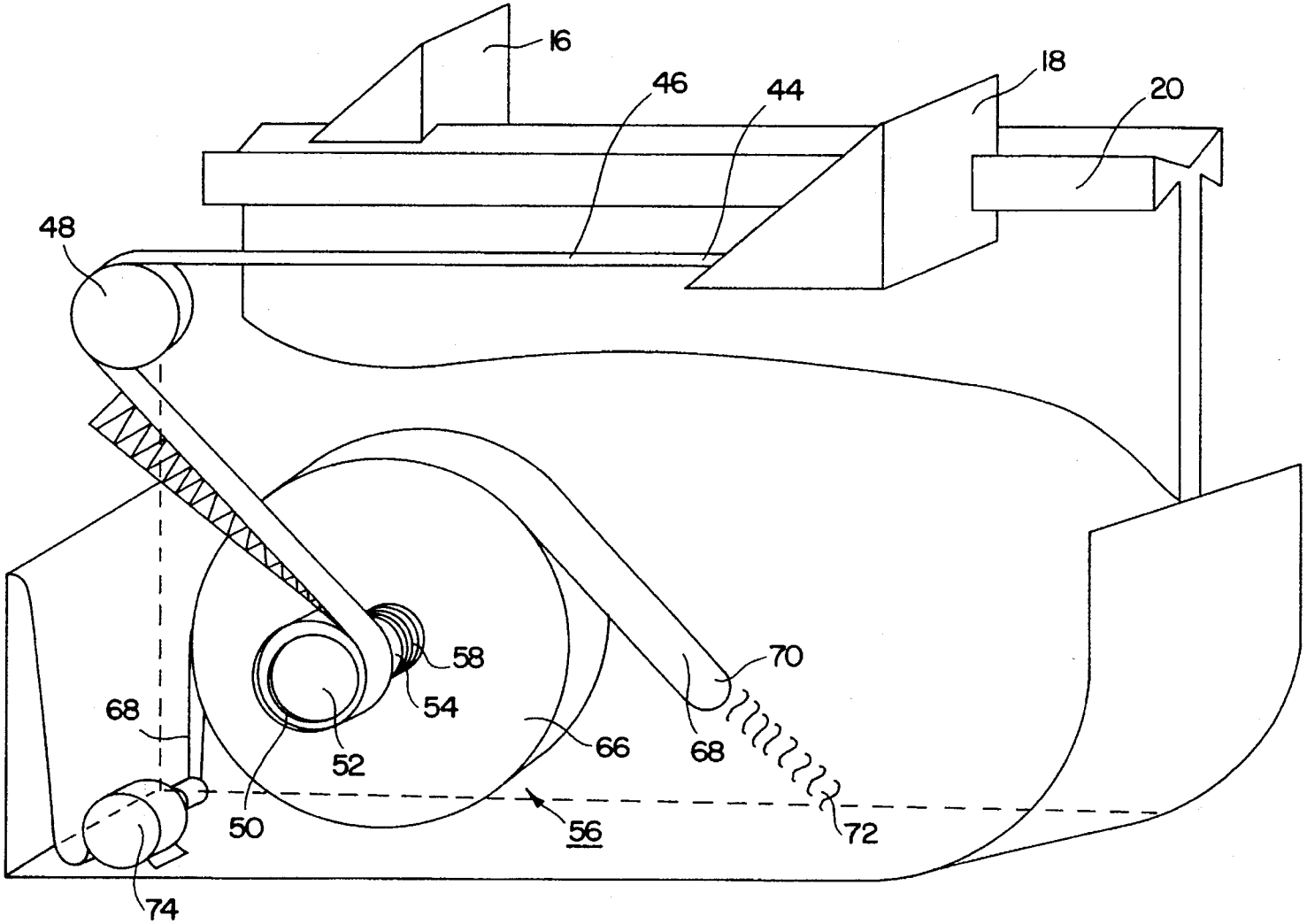
FIG. 2 shows an embodiment incorporating a weight wheel and friction band for applying resistance to the pedals and arrangement for shortening the return period.

FIG. 2 shows each pedal 16 and 18 slidably mounted on a linear track 20. The construction of the sliding mechanism can be selected from any one of a number of constructions that are disclosed in the prior an such as a simple dovetail slide as shown in the FIGS. 2–9 or a more complicated array of rollers and bearing as disclosed in the patent to Sweeney which is incorporated by reference in this specification. One end 44 of a flat belt 46 is respectively secured to one pedal 14 and is looped around an idler wheel 48 which is positioned at an end of the track closest to the user. The other end 50 of the belt 46 is wrapped around and secured to a drive shaft 52 which is coupled through a one way clutch 54 to a resistance wheel assembly 56. It will be understood that pedal 16 is assembled with a belt, idler wheel, etc., in mirror image to pedal 14. The relative arrangement of the pedal 18, idler 48 and driveshaft 52 is an important feature of this invention that permits the track to be positioned above the seat, the direction of the track 20 to be aligned with the direction in which force by the legs is greatest, and the drive shaft 52 coupled with the resistance wheel assembly 56 is positioned conveniently displaced from the line of direction of the track so that it will not interfere with the motion of the legs yet is also a more compact arrangement than the devices of the prior art which is an important consideration particularly in the domestic market.

One way clutches 54 such as represented in FIGS. 2–10 are well known in the bicycle art and therefore details as to the construction of the clutch are not included in this specification. The relative positions of the clutch 54, drive shaft 52 and spring return 58 are indicated in FIG. 2. A spring return 58 is provided which cooperates with the oneway clutch 54 to return the pedal 16 to its starting location after force is removed from the pedal.

FIG. 10 A is a sectional plan view and FIG. 10B is a side view showing one embodiment of the clutch-belt-spring return assembly in detail. One way clutch 54 is shown as including a first clutch end 54 A coupled in one direction to a second clutch end 54B. First clutch end 54A is coupled into a born of chive shaft. 52. A coil spring 58 is positioned between first clutch end 54A and the inside of chive shaft 52 Second clutch end 54B is coupled to an axle of a resistance wheel assembly (not shown in FIG. 10 A or B.). As the pedal is depressed, the flat belt unwraps around the driveshaft 52 which is mounted on one way clutch 54, and the radius, R, of the belt coil is reduced. The typical clutch 54 includes a drive member 54A and a driven shaft member 54B. This has important ramifications as discussed below.

The return spring 58 is clamped at one end 60 to the housing 24 and at the other end 62 to the drive shaft 52. As the force, F, is applied to unwind the belt coil, the resistive torque T generated by the spring 58 will increase according to $$T=A+B\theta$$

where $\Theta$ is the angular displacement of the drive shaft relative to an arbitrary reference where $\Theta-0$ and A and B are constants.

The pull on the belt, force F, will exert an opposing torque, $$F\times R=F(r-C\theta)$$

where r is the radius of the belt coil at the starting point of the pedal. Since T=F×R, $$F=(A+BO)/(r-C\Theta)$$

To a first approximation, $$F=(A+B\Theta)(1+C\Theta)/r=(A+\{B+C\}\Theta)/r$$

showing that the construction in FIG. 10 has an effective restoring force constant of $$\{B+C\}\Theta/r$$

thereby shortening the return period of the spring.

FIG. 2 shows an arrangement for enhancing this effect. This is achieved by attaching a flexible wedge 64 to the belt which wraps with the belt around the shaft as the shaft turns.

It should also be noted that, by securing the belt directly to the drive shaft, rather than engaging the belt to the spring as disclosed in the Sweeny patent, there is no problem of the belt slipping on the shaft as posed in the prior at.

Figure 3:
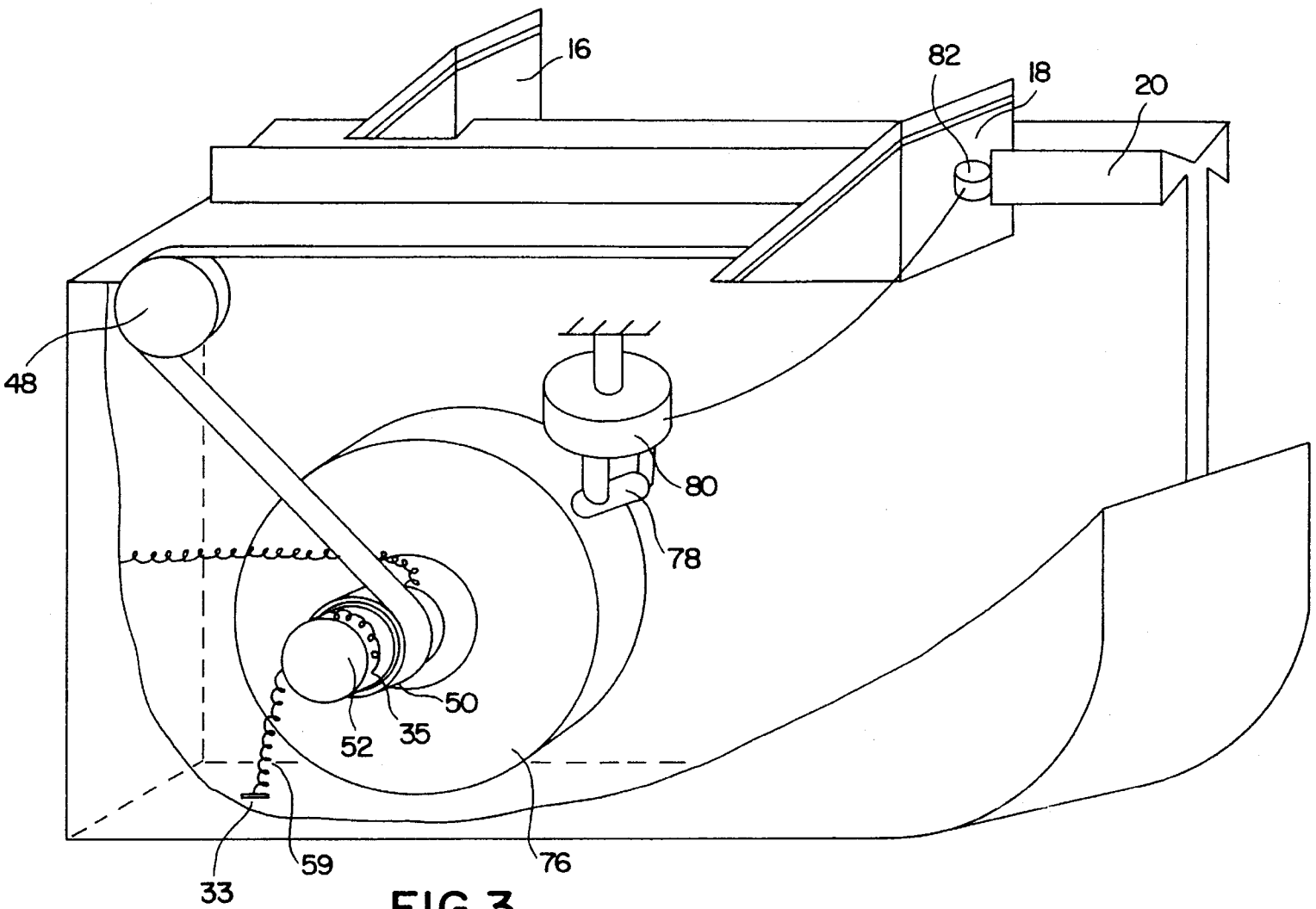
FIG. 3 shows an embodiment incorporating a rubber tire to impose resistance to turning.
Figure 4:
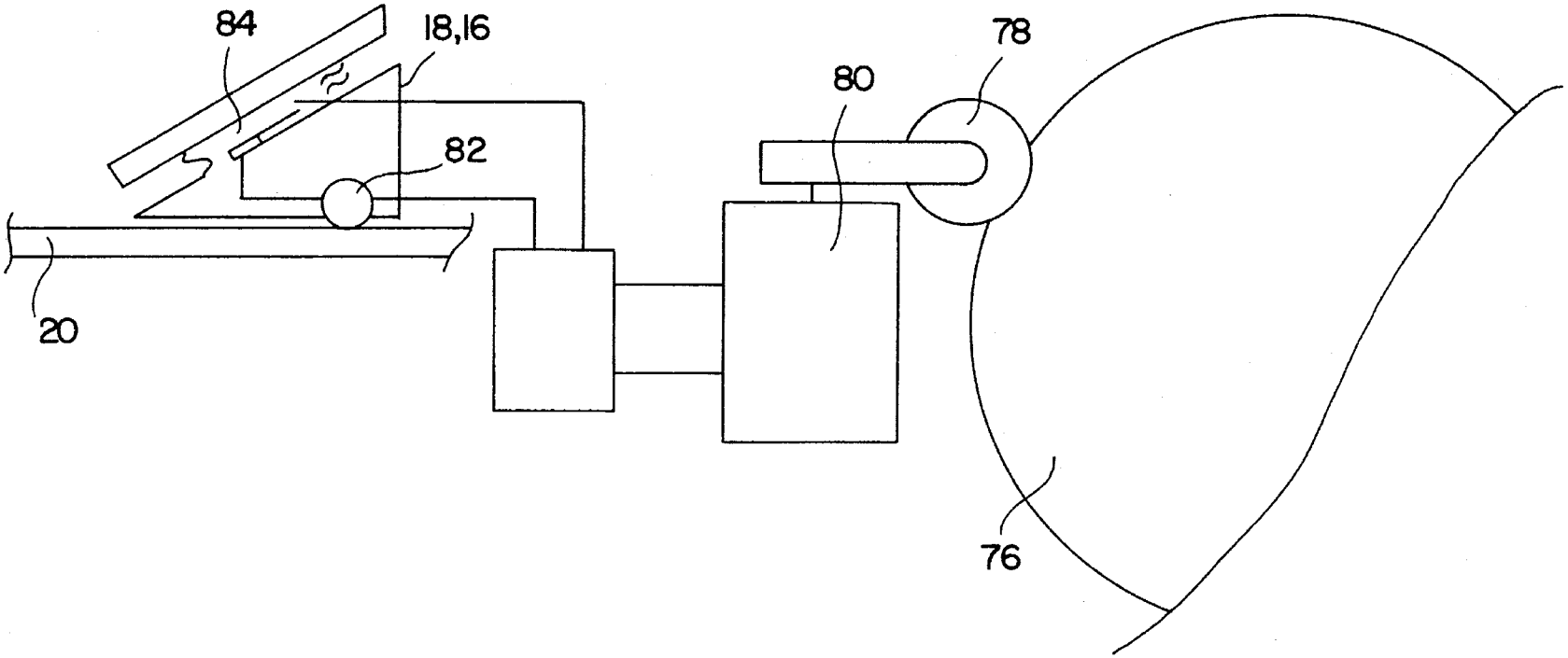
FIG. 4 shows an electrical method for controlling force of a roller against the rubber tire to impose variable resistance which is a function of pedal position.

FIG. 3 shows another embodiment for a spring return in which the end of the spring 59 is attached to the base at location 33 and to the drive shaft 52 at location 35. In this embodiment, linear spring 59 wraps around the driveshaft 52.

A number of resistance wheel assemblies 56 may be used which are embodiments of this invention such as are illustrated in FIGS. 2–9.

FIG. 2 shows a weight wheel 66, rotatably mounted and coupled to the oneway chuck 54. A friction band 68 is wrapped around the wheel 66 having one end 70 attached to tensioning spring 72 and the other end attached to a rotational actuator 74 which controls tension in the band 68.

FIG. 3 shows a resistance wheel assembly including a rubber tire 76 rotatably mounted. A roller 78 is pressed in contact with the wheel, thereby, deforming the tire 76 in the vicinity of contact with the roller 78. Deformation of the tire generates a resistance to rotating the tire that does not wear out the tire in contrast to the friction belt arrangement of FIG. 2.

FIG. 3 also shows that force on the roller may be applied by a linear actuator 80 which is controlled by a signal responsive to the position of the pedals 14 and 16. This may be accomplished (as also shown to greater advantage in FIG. 4), e.g., by a rotary rheostat 82 (variable resistance) that engages the track 20 and turns as the pedal 16 and/or 18 moves. An additional feature to this embodiment is a switch 84 in pedal 14 respectively which is open when the foot is disengaged from the pedal 16 but applies power to the actuator 80 when the pedal is depressed.

The linear actuator 80 may be a solenoid such as can be purchased from W. W. Grainger, Inc., SanJose, Calif.

Figure 5:
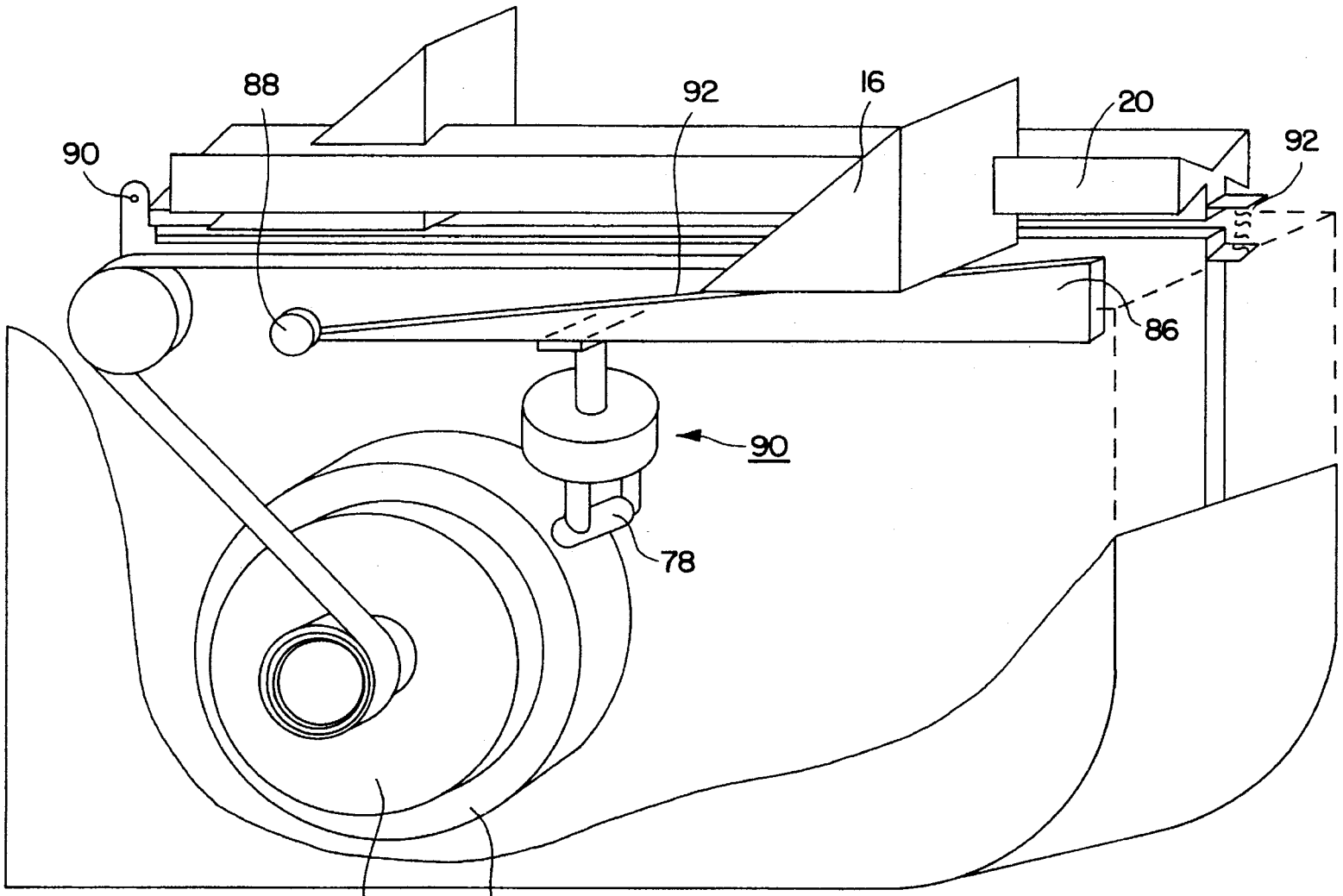
FIG. 5 shows a mechanical method for controlling force of a roller against a rubber tire to impose variable resistance which is a function of pedal position.

FIG. 5 shows a mechanical arrangement for controlling the resistance to turning the tire 76. A cam 86 pivots about one end 88. Roller assembly 90. is mounted on the bottom edge of the cam 86. A surface 92 of the cam 86 also slidably engages the pedal 16 such that, as the pedal 16 moves along the track 20, the force of the roller 78 on the tire 76 is a function of the position of the pedal 16.

An additional feature of this embodiment is achieved by hinging the track 20 at one end 90 and spring loading the other end by spring 93 so that the hinged track section 20 will lift the roller 78 out of contact with the tire 76 immediately when the foot is lifted off the pedal 16 regardless of the position of the pedal 16 thereby permitting the wheel 76 to continue turning without being slowed down by contact with the roller 78. If the wheel is a composite wheel including a rubber tired wheel 76 and a weight wheel 77 mounted on the same axle, then the wheel assembly will gain momentum (and speed) with each stroke and not be slowed when the roller 76 is withdrawn from the tire with the return of the pedal 16. This feature would appeal to a user who wishes to operate the pedals at high speed against strong resistance.

Figure 6:
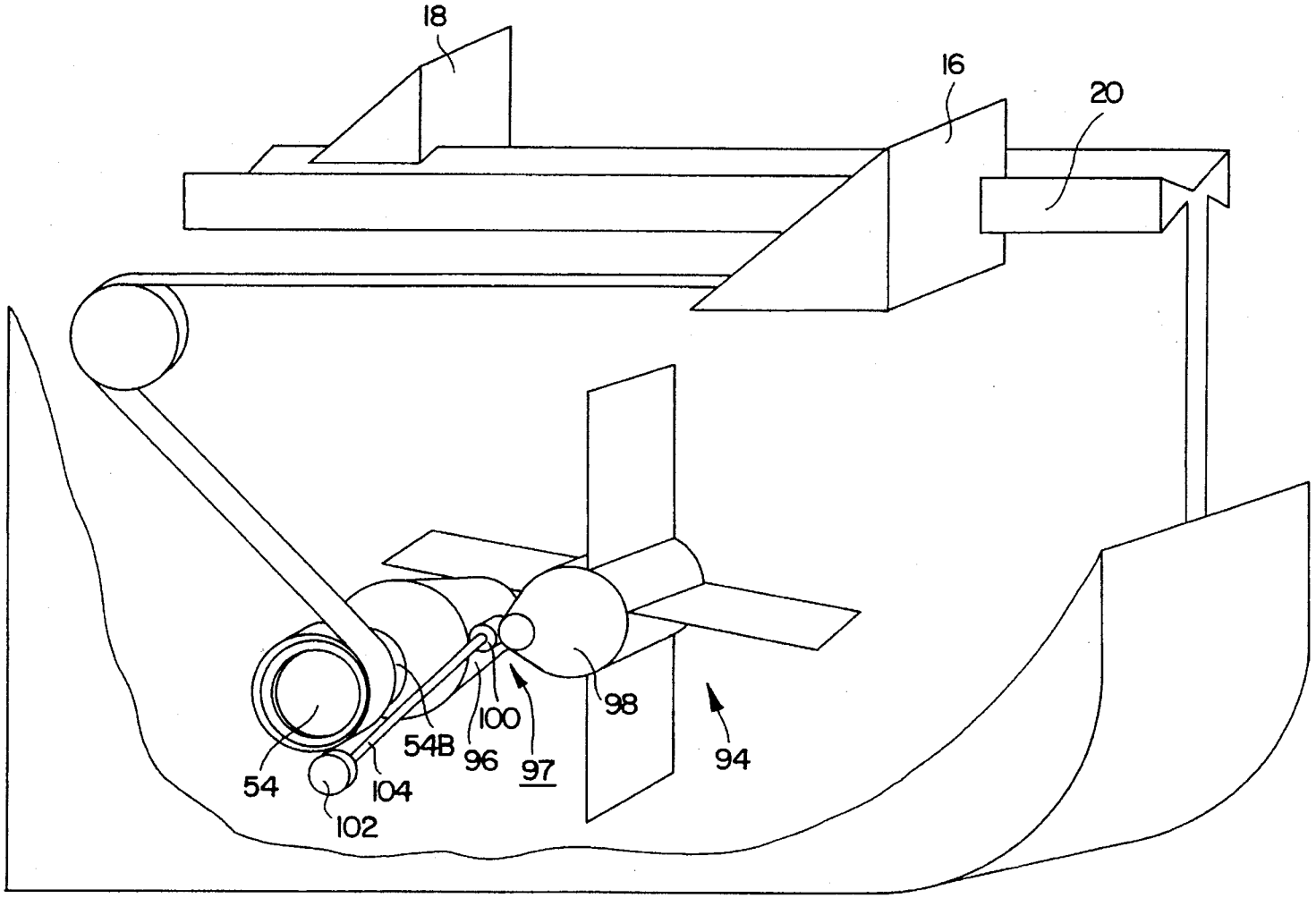
FIG. 6 shows resistance to movement of the pedals imposed by a fan whose velocity is controlled by a variable transmission.

FIG. 6 shows a resistance wheel assembly including a fan 94 to provide wind resistance to operating pedals 16 and 18. The output end 54 B from the oneway clutch 54 is coupled to the fan 94 by a variable transmission including a first cone 96, coupled to the oneway clutch 54 and coupled to a second cone 98 which is coupled to the axle of the fan 94. The ratio of rotational velocities of the first and second cones is determined by the position of the rotating rider 100 contacting the surfaces of both cones 96 and 98. The position of rider 100 is controlled by the user turninging knob 102. on stem 104 which is screwed into a support (not shown). Rider 100 is rotatably mounted on stem 104.

Another arrangement for controlling the velocity of fan 94 as a function of the speed of the pedal is shown in FIG. 11. The variable transmission includes first cone 96 coupled to drive shaft 52. and second cone 98 coupled to fan 94. Rider 100 engages the surfaces of both cones 96 and 98. Rider 100 is journalled onto shaft 101 by beating 103. Rider 100 is positionable by turning shaft 101 threaded through base 105 and coupled to rotary actuator 107. Generator 111 is in contact with first cone 96 and sends a signal corresponding to the rotational velocity of first cone 96 to controller 109. Controller 109 thus sends a programmed signal to the rotational actuator 107 which positions rider 100 to provide the desired rotational velocity of second cone 98.

Although the rotational velocity signal is generated by an electrical generator in FIG. 11, it will be a number of alternative devices for detecting rotational velocity could be used including Hall detectors and optical detectors.

Figure 7:
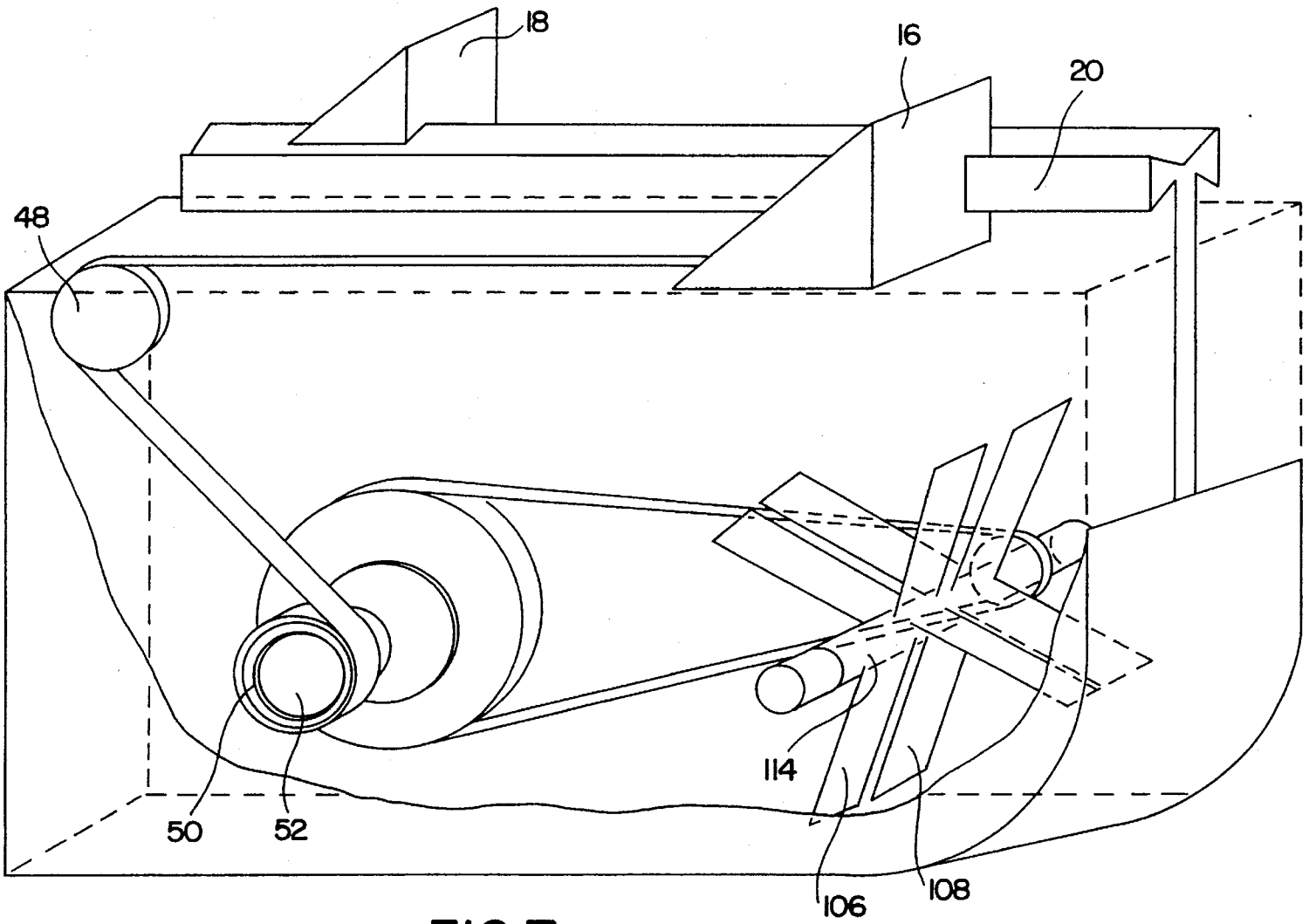
FIG. 7 shows resistance to movement of the pedals imposed by a fan in which the area of the fan blades is variable.
Figure 8:
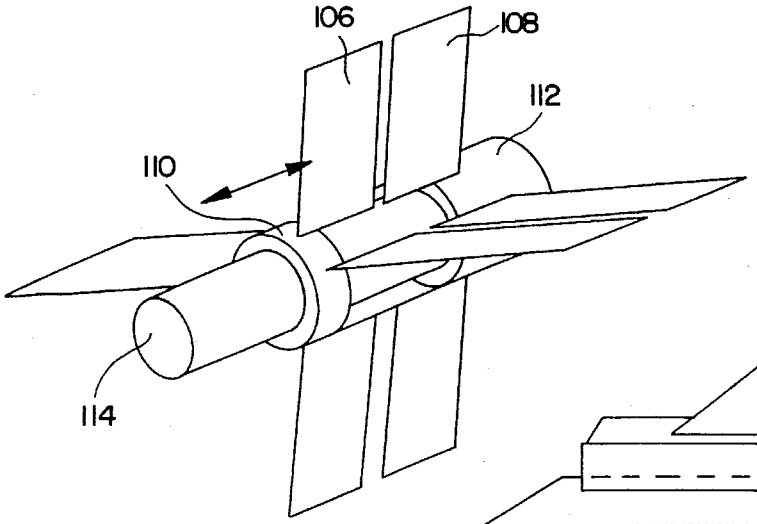
FIG. 8 shows a collar arrangement for controlling effective area of the fan blades.

FIG. 7 shows a resistance wheel assembly including a fan in which two sets of blades 106 and 108 are interleaved. As shown in greater detail in FIG. 8, each of the sets is mounted on a sleeve 110 and 112, respectively, so that, in order to increase resistance to turning, the sleeves 110 and 112 are moved apart on the shaft 114. The relative positions of the sleeves may be controlled by a linear actuator (not shown).

Figure 9:
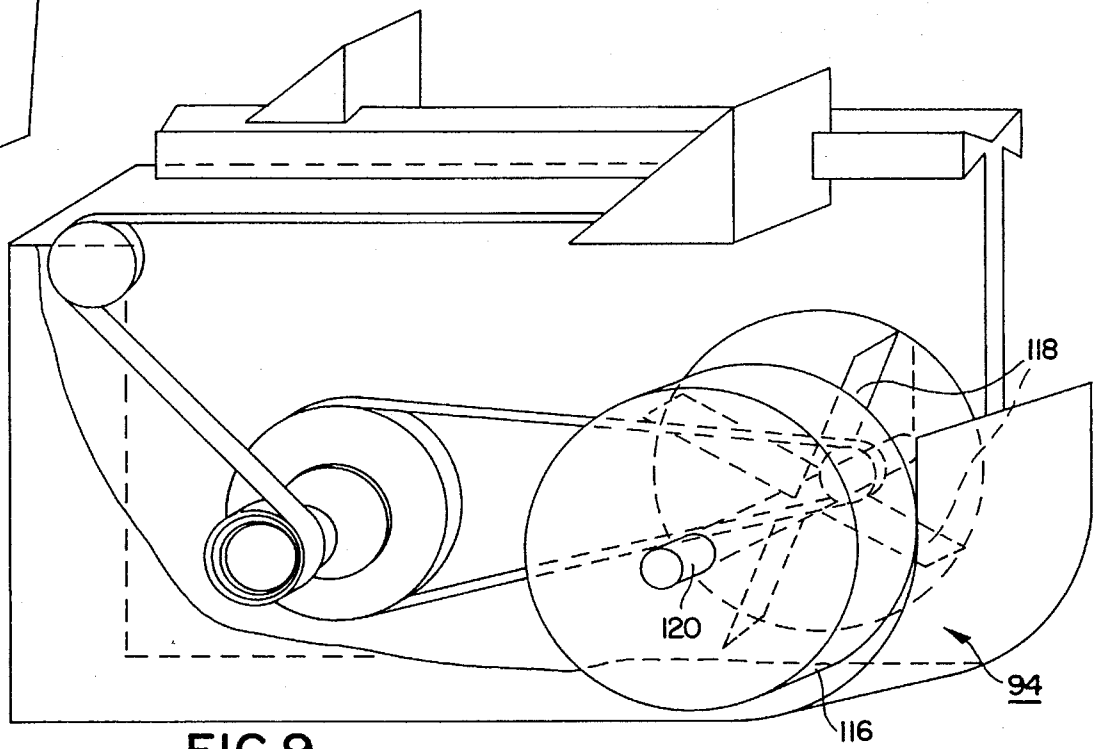
FIG. 9 shows a sliding shield which is positionable to control wind resistance of rotating fan blades.

FIG. 9 shows a fan assembly 94 in which the resistance to turning is controlled by a shield 116 that uncovers the fan blades 118 in order to increase wind resistance. The shield is 116 is slidably mounted on the shaft 120 and may be positioned manually or by a linear actuator (not shown). Position of the shield 116 is used to control the dependence of wind resistance on velocity of rotation of the fan. When the shield 116 covers the blades 118, the resistance to turning the fan 94 is proportional to rotational velocity of the fan. When the blades 118 are uncovered, resistance to turning the fan is proportional to the square of the velocity.

In the foregoing paragraphs embodiments have been described which meet the objects of the invention. The crux of the invention is an apparatus in which a user can operate reciprocating pedals while in a recumbent position wherein the pedals operate independently of one another, are mounted on a substantially horizontal track positionable in the vertical direction and present a resistance to turning that can be changed as a function of position of the pedal or dependent on other factors such as a function of speed. The arrangement of the components of the apparatus provides that the line of force for driving the pedals can be conveniently located above the level of the heart.

Recumbent in the context of this application is taken to mean "reclining", i.e., a posture that is between sitting erect as one does on a bicycle seat and lying down.

Resistance to turning is provided by a wheel assembly that can include a fan, a weight wheel or elastomeric tire. Each of these modes of resistance provide unique characteristics regarding dependence of resistance on velocity, position of the pedals, etc.

The apparatus of this invention has a number of advantages over devices of the prior art.

For example, dependence of resistance on deformation of a rubber wheel rather on the frictional devices of the prior an avoids the problem of friction band wear and breakage associated with the friction bands of the prior art. Use of a roller on a rubber wheel also provides a precise measure of control of resistance such as dependence on instantaneous position of the pedal and release of the resistance during return of the pedal that is not afforded by other methods of providing resistance. Another advantage of the use of the inflatable rubber tire in contact with the roller is that the level of resistance can be controlled by the air pressure in the tire.

Resistance to moving the pedal is readily programmable to be a function of the pedal position.

The placement of the drive shaft and attachment of the belt to the drive shaft is a much simpler, more economic construction than apparatus of the prior art. This arrangement also makes feasible placing the track directly above the resistance wheel assembly in keeping with the object to position the track above the level of the heart. Rotational velocity of the wheel assembly may be controlled by the user from being proportional to rotational velocity, when the fan is completely shielded, to being proportional to the square of the velocity which occurs when the shield is withdrawn from the fan.

The combination of a linear stroke, and beginning the stroke with the knees close to the chest and ending with the knees and hips completely extended enables the user to perform a much more natural movement than the arcurate stroke required by the Sweeney disclosure or the stroke performed with the Rogers device in which the user is sitting over the track. The range of motion of the stroke using the present invention is markedly greater than either the Sweeney or Rogers invention because the beginning of the stroke is with the knees close to the chest so that both the hip and knees joints are completely flexed and ends with the hip and knee joints fully extended.

The Sweeney disclosure is strictly applicable to a user standing erect rather than assuming a recumbent posture. The pedals are required to operate independent of one another in order that the user may stand on one foot and push on a pedal with his other foot. On the other hand, the independent pedals incorporated into the present apparatus allows the user to perform different exercises. For example, he may stroke with both feet simultaneously by extending one leg while withdrawing the second leg or he may push with both feet at one time. Or he may exercise only one leg at a time. Exercising only one leg at a time while in a recumbent position may be beneficial to a user who is recovering from an injury to one leg or to a user who is required to maintain a very low exertion such as a recovering heart patient, etc.

The elevation of the starting and end points of the stroke may be established by adjustment of legs supporting a base frame and by orienting section of the with respect to one another. This arrangement is in contrast to the Rogers invention in which, although the stroke is linear, the track has only one section and the plane of the seat is fixed, parallel to the direction of the track and at an elevation above the track. Therefore, the maximum flexion that can be achieved is with the feet approaching the buttocks and the hips cannot be completely flexed. The Rogers arrangement therefore isolates the effort to push the pedals on the knee extensors rather than the hip extensors when the knees are closest to the chest. This is an unnatural movement that- is avoided in the present invention by positioning the track in front and above the seat. Positioning the track above the seat is accomplished by a novel arrangement in which a linkage extends from the end of the pedal closest to the user, directly toward the user then looping around the idler and extending down to the drivewheel.

The relative position of track, pedal, drivewheel and idler can also be used in an inverted arrangement for use by bedridden patients.

The return spring assembly of the present invention is attached to the drive shaft rather than being attached to the pedal as is done in the Sweeney disclosure. This arrangement is more compact than in the Sweeney construction and provides a faster return of the pedals because, in the Sweeney construction, a pedal on the end of a lever arm presents a greater angular moment of inertia than the present invention where there is no pedal on a lever arm. Fast return of the pedals is an important requirement for a recumbent stepper in order not to limit the repetition rate of the stroke.

Modifications may be incorporated which are within the scope of the invention.

For example, in the above descriptions, the housing 24 serves as a base means for supporting the track, wheel assemblies, etc. The base means may take other forms such as an elongated beam or parallel beams.

The exerciser may be constructed using belts such as "V" belts, round belts or sprocket chains and sprocket gears although these latter linkages are normally used to eliminate slippage and slippage can not occur with the arrangement of the present invention where the belt is secured to the drive shaft.

The continuously variable transmission 97 comprising cones 96 and 98 and rider 100 may be used to couple weight wheel 66 to the one way clutch 54 shown in FIG. 2 or to couple the wheel with rubber tire to the one way clutch.

A major feature of this invention is performance of pedalling exercises in which the user is in a recumbent (seated) position and operates each pedal independent of one another that are located in front of him. As discussed above, this feature enables the user to perform a variety of exercises such as using one leg at a time or both legs together.

FIG. 12 shows an embodiment having this feature in which the pedals 202 are mounted on the end of pedal cranks 200. There are shown the seat 194, with an adjustment 196 for adjusting the distance between the seat and the pedals. Each pedal is mounted on one end of its respective pedal crank. The other end of the pedal crank is coupled to a resistance device 198 mounted inside the housing of the resistance device.

One construction of a resistance device 198 is shown in cross section in FIG. 13. There are shown two pedal cranks 200 with pedals 202 on one end and whose other ends are secured to the outer races 204 respectively of a pair of roller clutches. The roller clutches are mounted on a shaft 206 journalled by bearings 208 to opposite interior surfaces of housing 210. (Housing 210 is partially cut away in FIG. 12. And is shown in cross section. Helical coil springs 212 are positioned concentric with the shaft 206 but have one end 214 secured to the housing 210 and the other end 216 secured to the outer race of the roller clutch 204. The springs 212 are biased to return the pedals to the rest position. A wheel 220 having an elastomeric rim 226 is mounted on the shaft 206. A resistance roller 222 is pressed against the wheel 220. The roller 222 is mounted on a yoke 228 such that force against the rim of wheel 220 is adjustable by knob 230 which turns screw 232 threaded through hosing 210. Screw 232 abutts motor support plate 233.

Other means for applying resistance may be used which are also embodiments of the invention. For example, instead of the resistance wheel, the drive shaft could be coupled by a sprocket and sprocket chain to a fan as discussed in foregoing embodiments. The wheel could have sufficient mass to provide appropriate resistance to changing the velocity of the wheel.

Another version is shown in FIG. 14. The drive shaft 235 is journalled on one end 234 to the housing 210 and coupled on the other end to an adjustable speed motor 236 through a disk clutch 240 (having one disk secured to the end of the drive shaft 235 and the other disk 242 coupled to the motor 236). The force between the disks is adjustable by knob 246 which turns screw 232. As long as the rotational velocity of the outer race (driven by the pedals 250) exerted by the pedals is below the motor speed, the the drive shaft turns with the motor 236. When the rotational velocity of the drive shaft 235 exceeds the motor speed, the friction clutch (240–242) must slip and resistive force (due to the drag of the motor) imposes resistance to operating the pedals.

FIG. 15 shows another version in which an adjustable speed motor 252 has a worm 254 on its shaft engaged with a worm gear 256. The worm gear 256 is mounted on a drive shaft 258 which passes through the inner race of a one way roller clutch 260. The outer races of oneway clutches 260 are coupled to ends of pedal cranks 200.

The user can therefore operate the pedals with no resistance up to a rate that is determined by the speed of rotation of the motor. The motor prevents the pedals from turning at a rate that is faster than the preset rate so that the load from the motor exerts a counter force that is equal to the force exerted by the pedals. I therefore wish to define the scope of this invention by the appended claims and in view of the specification if need be.

I claim:

1. An exercise apparatus for perfoming pedalling exercise by a user in a recumbent position which comprises:

a base means having an elongated dimension with a first end and a second end and adapted for being supported with said elongated dimension in a substantially horizontal direction;

a pair of guide means for guiding respectively one pedal of a pair of pedals on a path between a first guide position closest to said first base end and a second guide position closest to said second base end;

said pair of pedals, each mounted on a respective one of said guide means;

a pair of idler pulley wheels, each rotatably mounted on said base means adjacent and below said first guide position with axes substantially perpendicular to said direction;

a pair of drive shafts, each rotatably mounted below said idler pulley substantially perpendicular to said direction and each having a first and second shaft end;

a pair of flexible linkages, each having a first linkage end secured to one of said guide means and a second linkage end secured to and wrapped around a first one of said drive shafts and looped around one of said idler pulley wheels respectively;

a pair of one way clutch means having a first clutch end coupled to one of said second shaft ends respectively and a second clutch end for permitting said respective drive shaft to turn said second clutch end in one direction only;

a wheel assembly means for providing resistance to movement of said pedals in said direction from said first guide position toward said second guide position including a wheel axle rotatably mounted with one end coupled to one said second clutch end and another end rigidly coupled to said other second clutch end;

a pair of spring return means, each having one end secured to said base means and another end secured to one of said drive shafts respectively for returning said respective pedal to a starting position adjacent to said first track end;

said base means, pair of guide means, pedals, pulley wheels, drive shafts, linkages, clutch means, spring return means, and wheel assembly means arranged in operable combination with one another to permit a user to force each one of said pedals to from said first guide position toward said second guide position against a force of resistance provided by turning said wheel assembly means and return said pedal to said first guide position when the user releases said pedal.

2. An exercise apparatus as in claim 1 which comprises: said pair of guide means being a pair of tracks, each track mounted on said base means and having a first track end closest to said first base end and a second track end closest to said second base end.

3. An apparatus as in claim 2 wherein said linkage comprises a flat belt arranged to provide that said second linkage end will generate a flat expanding coil as it is wrapped around said first shaft end, respectively, thereby increasing an effective force constant of said spring return means.

4. An apparatus as in claim 3 wherein said linkage means comprises a flexible wedge secured on said flat belt.

5. An apparatus as in claim 2 wherein said spring return means comprises a helical spring positioned coaxially with said drive shaft respectively.

6. An apparatus as in claim 2 wherein said spring return means comprises a linear spring having one end secured to said base and a second end secured to said drive shaft.

7. An apparatus as in claim 2 wherein each said spring return means comprises:

a cone mounted coaxially on one said drive shaft respectively and having a surface and a large radius end and a small radius end and a cone slope;

a spiral helical spring including a plurality of progressively smaller loops to define a spring slope and mounted over said cone with a large loop end secured to said cone surface adjacent to said large radius cone end and a small loop end adjacent to said small radius cone end and secured to said base means;

said spring slope and cone slope selected in operable combination to provide that, as said cone on said drive shaft rotates, thereby reducing diameters of said loops, each said loop will progressively contact said cone surface thereby providing that torque required to turn said cone about its axis will remain constant.

8. An apparatus as in claim 2 wherein said wheel assembly means comprises:

a weight wheel mounted on said axle, a friction band wrapped around a periphery of said weight wheel and having one end secured to a tension spring and a second end;

said tension spring secured to said base means;

a means for applying tension to said friction band secured to said base means and to said second end of said friction band.

9. An apparatus as in claim 8 which comprises a continuously variable transmission coupled to the weight wheel and the one way clutch.

10. An apparatus as in claim 1 wherein said wheel assembly means comprises a fan assembly means mounted on said axle for generating wind resistance to turning each said drive shaft.

11. An apparatus as in claim 10 wherein said fan assembly means comprises:

a plurality of fan blades, each blade having an end secured to said axle and extending radially away from said axle;

a shield means for shielding said fan blades slidably mounted on said axle such that said shield means can be positioned in a range of positions between one position where said fan blades are completely shielded to a location where said fan blades are completely exposed.

12. An apparatus as in claim 2 which comprises a variable transmission means for adjusting rotational velocity of said wheel assembly means for a given speed of said pedals and coupled between said axle and one of said clutch ends.

13. An apparatus as in claim 12 wherein said variable transmission means comprises:

a first cone mounted to rotate with said second clutch end;

a second cone mounted to rotate with said axle;

a rider wheel rotatably mounted on said base means and contacting said first and second cones;

means for positioning said rider wheel mounted on said base means;

said first cone, second cone, rider wheel and positioning means all arranged in operable combination such that said positioning means be permitted to locate said rider wheel in contact with surfaces of both cones in a range of locations between one location where said first and second cones have smallest and largest diameters respectively and a second location where said first and second cones have largest and smallest diameters respectively.

14. An apparatus as in claim 13 wherein said positioning means comprises:

a means for producing a signal responsive to rotational velocity of said second clutch end;

computer means for receiving said velocity signal and processing said signal to generate a position signal;

an actuator means for receiving said position signal and positioning said rider in response to said position signal.

15. An apparatus as in claim 12 wherein said variable transmission comprises:

a rotatable input shaft coupled to one of said second clutch ends;

a rotatable output shaft coupled to rotate with said axle and coupled with said input shaft to rotate at a first rotational velocity that is a ratio of a second rotational velocity of said input shaft;

means for varying said ratio.

16. An apparatus as in claim 15 wherein said means for varying comprises:

a means for producing a velocity signal responsive to said second rotational velocity;

computer means for receiving said velocity signal and processing said velocity signal to generate a ratio signal;

an acuator means for receiving said ratio signal and adjusting said variable transmission means to provide that said output shaft rotate at said first rotational velocity which is said ratio of said second rotational velocity.

17. An apparatus as in claim 16 wherein said fan assembly means comprises:

a first and a second fan blade set, each blade set including a first and second collar respectively, each said collar having a plurality of fan blades having an end secured to said respective collar, said collars slidably mounted on said axle in operable combination with other said collar such that when said collars are positioned proximal to one another, each fan blade of said first fan blade set overlaps a corresponding one of said fan blades of said second blade set thereby providing minimal wind resistance to turning and when said collars are slidably positioned distal from one another, each said blade is separated from said corresponding blade;

means for positioning said collars on said axle secured to said base means.

18. An apparatus as in claim 2 wherein said wheel assembly means comprises:

an elastomeric tire mounted on said axle;

a roller;

means secured to said base means for forcing said roller against said tire thereby generating resistance force to rotating said tire.

19. An apparatus as in claim 18 wherein said forcing means comprises:

a cam means hingably attached to said base means, having a cam surface in contact with at least one of said pedal means, and said cam means supporting said roller such that, as said pedal moves and slides on said cam surface, said roller is forced against said tire with a force determined by a shape of said cam surface.

20. An apparatus as in claim 19 wherein:

said track means is hingably secured to said base means;

said roller is supported by said track means; and said apparatus comprises a pedal spring means secured to said base means and biased against said hingably mounted track means such as to maintain said roller out of contact with said said tire when said pedals are not forced to move by said user.

21. An apparatus as in claim 18 wherein said forcing means comprises:

a linear actuator mounted on said base means and coupled to said roller;

an electrical means for energizing said linear actuator to force said roller against said tire.

22. An apparatus as in claim 21 wherein said electrical energizing means comprises:

at least one rotary rheostat means mounted on one said pedal respectively and having two terminals connected across a variable resistance whose value is a function of a location of said respective pedal;

an electrical power means connected to said terminals for forcing said roller against said tire by a force responsive to said variable resistance.

23. An apparatus as in claim 22 wherein said electrical power means comprises a solenoid.

24. An apparatus as in claim 1 which comprises:

a beam means having an end secured to said first end of said base means and substantially parallel to said track means and extending away from said base means;

a seat slidably positionable and secured to said beam means.

25. An apparatus as in claim 24 wherein said beam means is positioned at a first elevation and said track is positioned at a second elevation and said second elevation is spaced from said first elevation at a distance selected from a range between 25 and 75 centimeters.

26. An apparatus as in claim 24 wherein said beam means comprises:

a first beam member having said end secured to said base means and a second end;

a second member supporting said seat and having a first end hingably attached to said second end of said first beam member permitting said seat to be tilted with respect to said track.

27. An apparatus as in claim 24 wherein said beam means comprises:

an end distal from said base means; and a leg having a length and a lower end supportable by the ground;

means for securing said leg to said distal beam end at a selected location along said length.

28. An apparatus as in claim 2 wherein said base means comprises a frame means for supporting said housing over a bed permitting said user to lie on his back in the bed and operate said pedals with his feet.

29. An apparatus as in claim 28 wherein said frame means comprises:

two horizontal side leg members and a horizontal joining member, said joining member having one end joined substantially perpendicular to an end of one of said side members and another end joined substantially perpendicular to an end of said other leg member thereby forming a u shaped base member;

a plurality of wheels rotatably secured to said horizontal leg members and oriented to support said frame means;

a vertical member secured at one end to said joining member;

an angle member having a vertical leg with an end telescoping onto an upper end of said vertical member and a horizontal leg joined at one end to an upper end of said vertical leg;

a horizontal beam member having one end telescoping onto a second end of said horizontal angle leg and supporting said housing.

30. An apparatus as in claim 2 wherein each said track is curved.

31. An exercise apparatus as in claim 1 wherein said pair of guide means is a pair of levers, each one having one end rotatably mounted on said base and one of said pedals mounted on a second end.

32. An exercise apparatus as in claim 31 wherein:

each one of said pair of levers comprises two members, each member having a first and second end;

one member of each lever having a respective one of said pedals rotatably mounted on a first end;

another member of each lever being rotatably mounted on said base means;

each one of said another member having a second end telescoping with a second end of said one member respectively.

* * * * *